US008851086B2

(12) United States Patent
Stachowski

(10) Patent No.: US 8,851,086 B2
(45) Date of Patent: Oct. 7, 2014

(54) EXPANDING HAIR BAND

(75) Inventor: Barbara Carey Stachowski, Orinda, CA (US)

(73) Assignee: Conair Corporation, Stamford, CT (US)

( * ) Notice: Subject to any disclaimer, the term of this patent is extended or adjusted under 35 U.S.C. 154(b) by 69 days.

(21) Appl. No.: 13/088,487

(22) Filed: Apr. 18, 2011

(65) Prior Publication Data

US 2011/0253159 A1 Oct. 20, 2011

Related U.S. Application Data

(60) Provisional application No. 61/325,676, filed on Apr. 19, 2010.

(51) Int. Cl.

| | |
|---|---|
| ***A45D 24/00*** | (2006.01) |
| ***A45D 7/00*** | (2006.01) |
| ***A45D 8/12*** | (2006.01) |
| ***A45D 8/00*** | (2006.01) |
| ***A41F 1/00*** | (2006.01) |
| ***A44B 1/04*** | (2006.01) |
| ***A44B 11/25*** | (2006.01) |
| ***A44B 17/00*** | (2006.01) |
| ***B42F 1/00*** | (2006.01) |
| ***A45D 8/36*** | (2006.01) |
| ***A45D 8/34*** | (2006.01) |

(52) U.S. Cl.

CPC ..... *A45D 8/36* (2013.01); *A45D 2008/004* (2013.01); *A45D 2007/002* (2013.01); *A45D 8/34* (2013.01)

USPC ..... 132/200; 132/273; 132/275; 24/482

(58) Field of Classification Search

CPC ..... A45D 8/00; A45D 8/34; A45D 8/36; A44B 6/00; A41F 11/16; A41F 11/18; A41F 13/00

USPC ..... 132/275, 200, 247, 248, 273, 278, 276, 132/212; 24/30.5 S, 563, 17 B, 129 R, 129 D, 24/482, 17 AP, 16 PB, 30.5 R; 2/DIG. 11, 2/171.03, 195.5, 171.4, 200.2, 195.3, 2/209.7, 171.8, 183; 119/607, 811, 856, 119/857, 600, 601, 618, 619, 802, 838; D28/10, 32, 33, 34, 39, 41

See application file for complete search history.

(56) References Cited

U.S. PATENT DOCUMENTS 2,547,295 A 4/1951 Weeks
2,595,657 A * 5/1952 Harmon ..... 132/273

(Continued)

FOREIGN PATENT DOCUMENTS

DE 44 37 871 A1 4/1996
FR 1 085911 A 2/1955

OTHER PUBLICATIONS http://web.archive.org/web/20080414191621/http://www.enasco.com/product/C00233N (Apr. 14, 2008).*

(Continued)

*Primary Examiner* — Vanitha Elgart

(74) *Attorney, Agent, or Firm* — Carter, DeLuca, Farrell & Schmidt, LLP

(57) ABSTRACT

A hair band comprises a stretchable body and a center hole. The center hole increases in diameter when the hair band is moved from a rest position to a stretched position. A distance between an outer edge of the body and an outer edge of the center hole is greater than the center hole diameter when the hair band is in a rest position. The distance between the outer edge of the center hole and the outer edge of the body decreases and the inner diameter increases as the hair band is stretched. In some embodiments, the body is hollow and filled with one or more of a gel substance, a granular solid, and a viscous liquid. In some embodiments, the hair band is manufactured by one or more of an extrusion molding process and an injection molding process.

22 Claims, 3 Drawing Sheets

(56) References Cited

U.S. PATENT DOCUMENTS

| | | | | |
|---|---|---|---|---|
| 2,775,245 | A * | 12/1956 | Behr | 132/273 |
| 3,692,317 | A * | 9/1972 | Augustin | 277/382 |
| 3,746,016 | A * | 7/1973 | Goodman | 132/274 |
| D239,673 | S | 4/1976 | Ziegler | |
| 4,317,337 | A * | 3/1982 | Walden et al. | 63/3 |
| 4,347,776 | A * | 9/1982 | Grass et al. | 84/383 R |
| 4,644,610 | A * | 2/1987 | Fish | 24/30.5 S |
| 4,785,834 | A * | 11/1988 | Gonzalez | 132/275 |
| 5,031,246 | A * | 7/1991 | Kronenberger | 2/195.2 |
| D322,145 | S | 12/1991 | Coignard | |
| 5,129,106 | A * | 7/1992 | Liou | 2/411 |
| 5,182,838 | A * | 2/1993 | Stenner | 24/712.7 |
| 5,301,696 | A * | 4/1994 | Revson | 132/273 |
| 5,388,598 | A | 2/1995 | Whitten | |
| 5,494,059 | A * | 2/1996 | Barrows et al. | 132/273 |
| 5,621,921 | A * | 4/1997 | Outland | 2/207 |
| 5,644,799 | A * | 7/1997 | Armenta et al. | 2/209.13 |
| 5,758,671 | A * | 6/1998 | Thim | 132/273 |
| 5,826,598 | A | 10/1998 | Meehan | |
| 5,933,872 | A * | 8/1999 | Lema | 2/209.7 |
| 5,946,728 | A | 9/1999 | Tane | |
| 6,016,813 | A | 1/2000 | Kennedy | |
| D420,931 | S | 2/2000 | Philipson et al. | |
| 6,041,792 | A | 3/2000 | Kennedy | |
| 6,047,708 | A | 4/2000 | Panel et al. | |
| D434,184 | S | 11/2000 | Acker | |
| D435,621 | S | 12/2000 | Peterson | |
| 6,182,672 | B1 * | 2/2001 | Abasta-Douglas et al. | 132/275 |
| 6,200,046 | B1 | 3/2001 | Rylander | |
| 6,209,549 | B1 | 4/2001 | Lunde | |
| D451,246 | S | 11/2001 | Zuckerman | |
| 6,311,699 | B1 * | 11/2001 | Horman | 132/278 |
| 6,314,969 | B1 | 11/2001 | Lacause | |
| 6,386,761 | B1 | 5/2002 | Bohnsack | |
| D463,621 | S | 9/2002 | Tobin | |
| D465,146 | S | 11/2002 | Koplin | |
| D476,865 | S | 7/2003 | Zudal | |
| 6,711,749 | B2 * | 3/2004 | White et al. | 2/195.8 |
| D492,218 | S | 6/2004 | Ross | |
| 6,936,269 | B2 * | 8/2005 | Robinson | 424/409 |
| D510,400 | S | 10/2005 | Rockstad et al. | |
| 6,996,853 | B2 * | 2/2006 | Gabriel | 2/174 |
| D526,442 | S | 8/2006 | Kim | |
| D529,746 | S | 10/2006 | Soleymani | |
| D534,754 | S | 1/2007 | Boutin | |
| D536,737 | S | 2/2007 | Lee | |
| D552,912 | S | 10/2007 | Boutin | |
| 7,305,996 | B2 * | 12/2007 | Kraft et al. | 132/273 |
| D586,042 | S | 2/2009 | Tsai | |
| D599,244 | S | 9/2009 | Momjian | |
| 7,581,548 | B2 * | 9/2009 | Henricksen et al. | 132/275 |
| D602,299 | S | 10/2009 | Heroux | |
| D619,353 | S | 7/2010 | Ash | |
| 7,749,257 | B2 * | 7/2010 | Medoff | 606/290 |
| D629,345 | S | 12/2010 | Schmid | |
| D646,435 | S * | 10/2011 | Carey | D28/41 |
| 2002/0035768 | A1 * | 3/2002 | Gaetke | 24/563 |
| 2002/0106526 | A1 * | 8/2002 | Kuramoto et al. | 428/520 |
| 2004/0040568 | A1 | 3/2004 | Tsai | |
| 2004/0177859 | A1 | 9/2004 | Coleman | |
| 2006/0021630 | A1 * | 2/2006 | Lafauci et al. | 132/273 |
| 2006/0137707 | A1 * | 6/2006 | Au | 132/273 |
| 2006/0157077 | A1 * | 7/2006 | Kraft et al. | 132/200 |
| 2007/0102019 | A1 * | 5/2007 | Sonstegard | 132/273 |
| 2007/0204809 | A1 * | 9/2007 | Markfield | 119/856 |
| 2008/0072923 | A1 | 3/2008 | Tropeano | |
| 2008/0099036 | A1 * | 5/2008 | Crowley et al. | 132/275 |
| 2008/0256759 | A1 * | 10/2008 | Kasbohm | 24/30.5 S |
| 2009/0301510 | A1 * | 12/2009 | Hsu | 132/273 |
| 2010/0180911 | A1 * | 7/2010 | Kraft et al. | 132/276 |
| 2011/0023904 | A1 * | 2/2011 | Hsu | 132/276 |
| 2013/0298930 | A1 * | 11/2013 | Stachowski | 132/200 |

OTHER PUBLICATIONS http://web.archive.org/web/20080516192934/http:/www.enasco.com/product/CN00232(X)N. (Apr. 14, 2008).*

Haefner, Jr, "The Use of Elastrator Rings for Binding Crab Claws," Chesapeake Science, Sep. 1971, vol. 12, Issue 3, pp. 183-184.*

European Search Report from corresponding EP application 11 77 2493 mailed Aug. 21, 2013 (6 pages).

* cited by examiner

EXPANDING HAIR BAND

RELATED APPLICATIONS

This Patent Application claims priority under 35 U.S.C. 119 (e) of the U.S. Provisional Patent Application, Ser. No. 61/325,676, filed Apr. 19, 2010, and entitled "Expanding Hair Band." The Provisional Patent Application, Ser. No. 61/325, 676, filed Apr. 19, 2010, and entitled "Expanding Hair Band" is also hereby incorporated by reference.

FIELD OF THE INVENTION

The presently claimed invention relates to hair accessories and hair accessory devices. More specifically, the presently claimed invention relates to stretchable hair bands for securely holding a portion of hair and for decorative purposes.

BACKGROUND OF THE INVENTION

Women's hair accessories are well known in the art and are available in a variety of fashions. Numerous devices have been developed to assist women in creating desirable hair arrangements. Depending on the occasion it may be desirable to use a hair accessory to position the hair in a certain arrangement or to securely hold the hair off the shoulders or away from the face. Consequently, a wide variety of hair accessories are available to securely hold the hair and for decorative purposes.

SUMMARY OF THE INVENTION

In one embodiment, a hair band comprises a stretchable body and a center hole. The center hole increases in diameter when the hair band is moved from a rest position to a stretched position. A distance between an outer edge of the body and an outer edge of the center hole is greater than the center hole diameter when the hair band is in a rest position. The distance between the outer edge of the center hole and the outer edge of the body decreases and the inner diameter increases as the hair band is stretched. In some embodiments, the body is hollow and filled with one or more of a gel substance, a granular solid, and a viscous liquid. In some embodiments, the body comprises fabric. In further embodiments, the body comprises one or more of a decorative pattern, a graphic, and a decorative accessory. In some embodiments, the hair band is manufactured by one or more of an extrusion molding process and an injection molding process.

In second aspect, a hair band with a stretchable body comprises an inner edge, an outer edge, and a center hole, wherein a distance between the inner edge and the outer edge is greater than a center hole diameter at a rest position, and the distance between the inner edge and the outer edge decreases when the hair band is at a stretched position. In some embodiments, the stretchable body is solid. In some embodiments, the stretchable body is hollow and filled with one or more of a gel substance, a granular solid, and a viscous liquid. In further embodiments, the body comprises a fabric surface. In some embodiments, the body comprises one or more of a decorative pattern, a graphic, and a decorative accessory. In some embodiments, a width of the body is approximately ¼ inch, the center hole diameter is approximately ⅛ inch in a rest position. In further embodiments, the body is infused with one or more of aloe, mineral oil, and a conditioning substance. In still further embodiments, the body comprises one or more of a sphere, a cube, and a tubular shape. In some embodiments, the body is infused with an aroma. In further embodiments, the body is infused with a bitterant. In some embodiments, the hair band is manufactured by one or more of an extrusion molding process and an injection molding process. In some embodiments, the body comprises one or more of a heart, insect, animal, flower, and other decorative shape. In further embodiments, the body comprises multiple designs.

In another aspect, a hair band comprises a stretchable body and a center hole, wherein a distance between an outer edge of the of the body and the center hole is greater than a first center hole diameter when the hair band is in a rest position, and wherein the distance between the outer edge of the body and the center hole is less than a second center hole diameter when the hair band is in a stretched position. In some embodiments, the stretchable body is solid. In some embodiments, the stretchable body is hollow and filled with one or more of a gel substance, a granular solid, and a viscous liquid. In further embodiments, the body comprises a fabric surface. In some embodiments, the body comprises one or more of a decorative pattern, a graphic, and a decorative accessory. In some embodiments, a width of the hair band is approximately ¼ inch, the center hole diameter is approximately ⅛ inch in a rest position. In further embodiments, the body is infused with one or more of aloe, mineral oil, and a conditioning substance. In still further embodiments, the body comprises one or more of a sphere, a cube, and a tubular shape. In some embodiments, the body is infused with an aroma. In further embodiments, the body is infused with a bitterant. In some embodiments, the hair band is manufactured by one or more of an extrusion molding process and an injection molding process. In some embodiments, the body comprises one or more of a heart, insect, animal, flower, and other decorative shape. In further embodiments, the body comprises multiple designs.

In a further aspect, a method of utilizing a hair band with a body and a center hole comprises moving the hair band from a first rest position with a first center hole diameter and a first distance between an outer edge and the center hole to a stretched position with a second center hole diameter and a second distance between the outer edge and the center hole, placing a portion of hair within the center hole, and releasing the hair band from the stretched position to a second rest position to securely hold the portion of hair, wherein when the hair band is in the second rest position, the center hole diameter is greater than the first center hole diameter and the distance between an outer edge and the center hole is greater than the first distance between an outer edge and the center hole.

DETAILED DESCRIPTION

Figure 1:
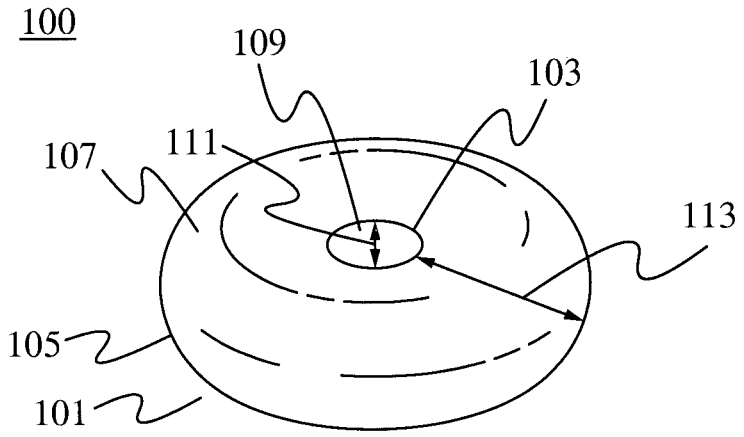
FIG. 1 illustrates a stretchable hair band in a rest position in accordance with some embodiments.

Referring now to FIG. 1, a first embodiment of the hair band in a rest position is depicted therein. The hair band 100 comprises a stretchable body 101 comprising an inner edge

103, an outer edge 105, a stretchable surface 107 between the inner edge 103 and the outer edge 105, and a center hole 109 with a diameter 111. As shown in FIG. 1, when the hair band is at a rest position, the center hole diameter 111 is less than the distance 113 between the inner edge 103 and the outer edge 105. In some embodiments, the hair band 100 is able to be moved to a stretched position (FIG. 2), wherein the center hole diameter 111 is greater than the distance between the inner edge and the outer edge 113.

In some embodiments, the body of the hair band 101 is solid. In some embodiments, the body 101 is hollow. In some of these embodiments, the body is filled with one or more of a gel substance, a granular solid, and a viscous liquid. In some embodiments, the body 101 comprises a fabric surface. In further embodiments, the body 101 further comprises one or more of a decorative pattern, a graphic and a decorative accessory. In some embodiments, the body comprises a width of approximately ¼ inch, the center hole comprises a diameter of approximately ⅛ inch at a rest position. Alternatively, the body 101 is able to comprise any width as known in the art and the center hole 109 is able to comprise any diameter as known in the art when the hair band 100 is at a rest position. In some embodiments, the body is infused with one or more of aloe, mineral oil, and a conditioning substance. Particularly, the body 101 is able to be infused with any hair product as known in the art. In some embodiments, the body 101 is infused with an aroma. In some embodiments, the body 101 is infused with a bitterant so as not to be attractive to small children and mistaken for candy. As will be clear to someone skilled in the art, the body is able to be infused with one or more of a hair product, an aroma, and a bitterant. In some embodiments, the body 101 comprises one or more of a sphere, a cube, and a tubular shape. In some embodiments, the hair band 100 is manufactured by one or more of an extrusion molding process and an injection molding process. Alternatively, the hair band 100 is manufactured by any method as is known in the art.

Figure 2:
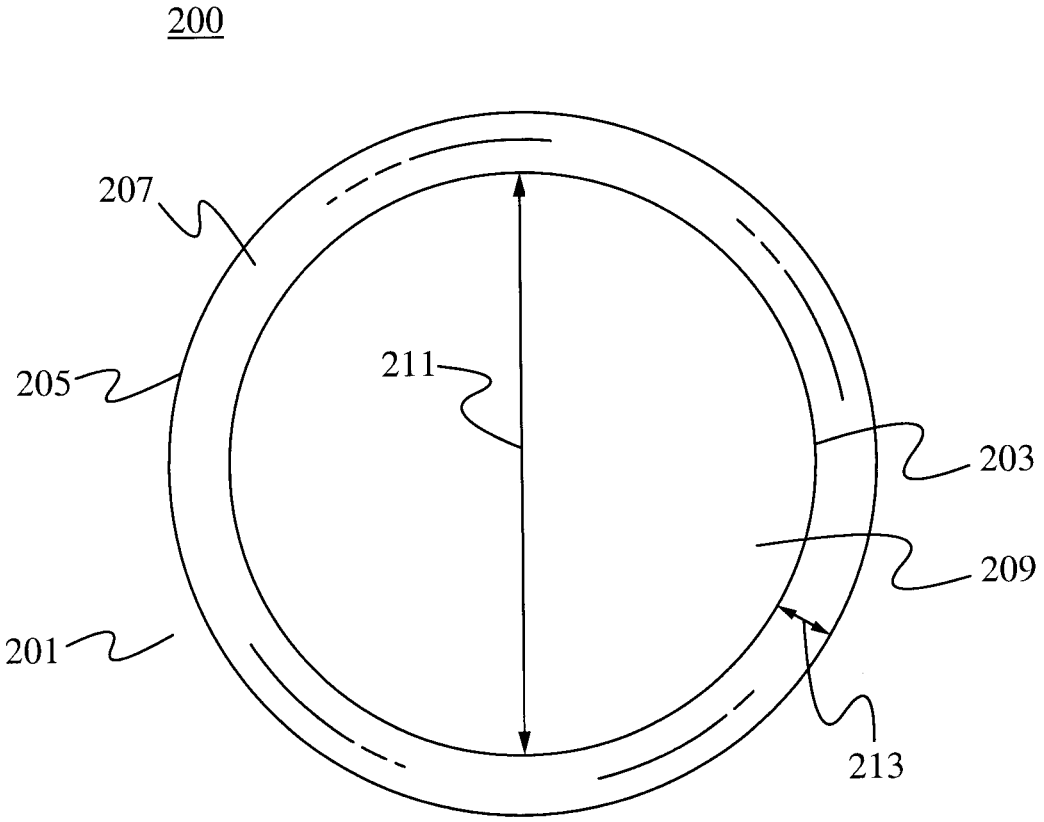
FIG. 2 illustrates a stretchable hair band in a stretched position in accordance with some embodiments.

FIG. 2 illustrates a stretchable hair band in a stretched position in accordance with some embodiments. The hair band 200 comprises a stretchable body 201 comprising an inner edge 203, an outer edge 205, a stretchable surface 207 between the inner edge 203 and the outer edge 205, and a center hole 209 with a diameter 211. As shown in FIG. 2, when the hair band 200 is in a stretched position the center hole diameter 211 is greater than the distance 213 between the inner edge 203 and the outer edge 205. In some embodiments, when the hair band 200 is in a stretched position the center hole diameter 211 is less than the distance between the inner edge and the outer edge 213. In some embodiments, when the hair band 200 is in a stretched position, the center hole diameter 211 is equal to the distance between the inner edge 203 and the outer edge 213. Particularly, as the hair band 200 is moved from a rest position to a stretched position, the distance 213 between the inner edge 203 and the outer edge 205 decreases and the center hole diameter 211 increases. As will be clear to someone skilled in the art, the hair band is able to move from a rest position with a first center hole diameter to a stretched position with a second center hole diameter and any intermediate position with an intermediate center hole diameter.

Figure 3:
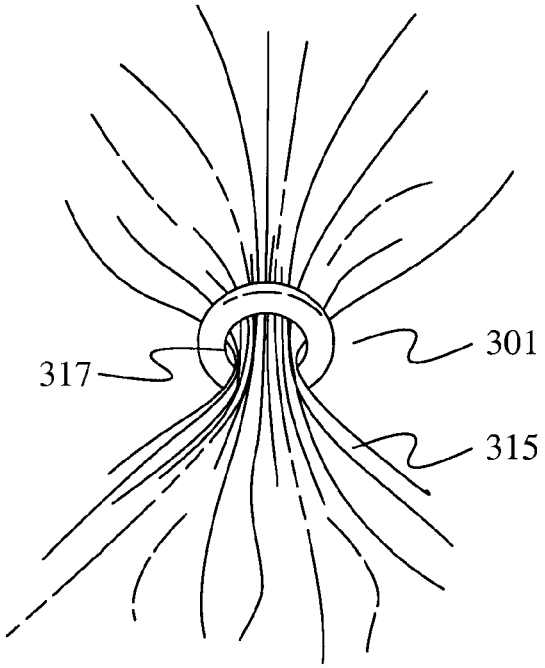
FIG. 3 illustrates a hair band being utilized to securely hold a portion of hair in accordance with some embodiments.

FIG. 3 illustrates a hair band being utilized to securely hold a portion of hair in accordance with some embodiments. As shown in FIG. 3, a user is able to utilize a hair band 301 to hold a portion of hair 315 in a desired configuration. The hair band 301 is able to be moved to a stretched position and utilized to hold hair in a variety of different styles and configurations.

Figure 4:
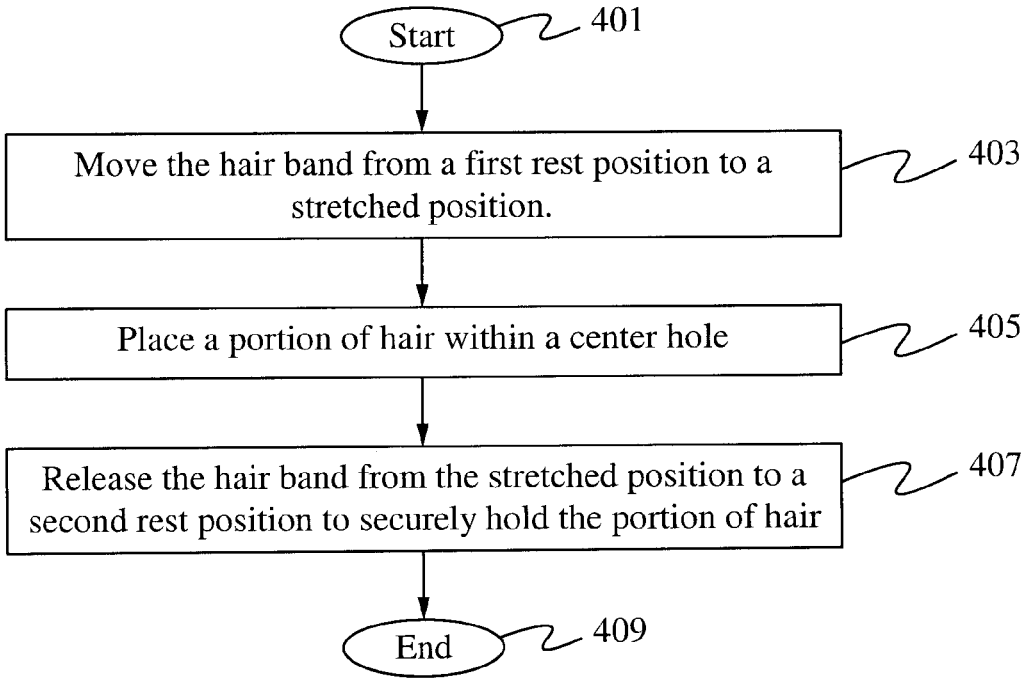
FIG. 4 illustrates a method of utilizing a hair band in accordance with some embodiments.

FIG. 4 illustrates a method of utilizing a hair band in accordance with some embodiments. As shown in the step 403, a user is able to move the hair band from a first rest position to a stretched position. In the first rest position, the hair band comprises a first center hole diameter and a first distance between an outer edge and the center hole and in the stretched position the hair band comprises a second center hole diameter and a second distance between the outer edge and the center hole. In the step 405, a portion of hair is placed within the center hole. As is clear to someone skilled in the art, different portions of hair are able to be placed within the center hole depending on the desired configuration of the user. In the step 407, the hair band is released from the stretched position to a second rest position to securely hold the portion of hair and the method is ended (step 409). When the hair band is in the second rest position, the center hole diameter is greater than the first center hole diameter and the distance between an outer edge and the center hole is greater than the first distance between an outer edge and the center hole. As will be clear to someone skilled in the art, the exact center hole diameter at the second rest position depends on the portion of hair held within the center hole.

Figure 5A:
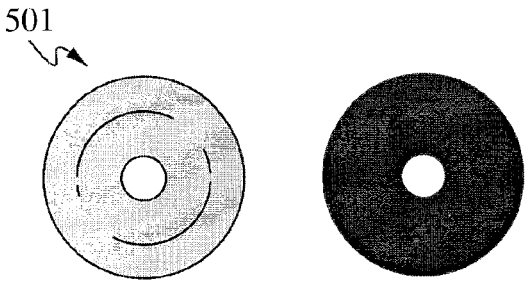
FIGS. 5A-5F illustrate a stretchable hair band in a rest position in accordance with some embodiments.
Figure 5B:
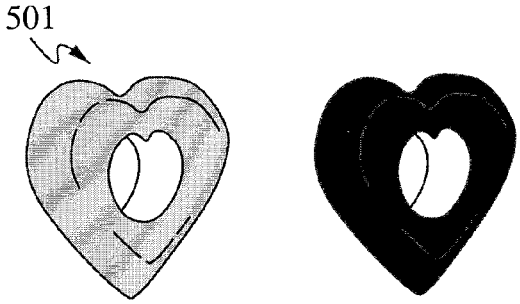
Figure 5C:
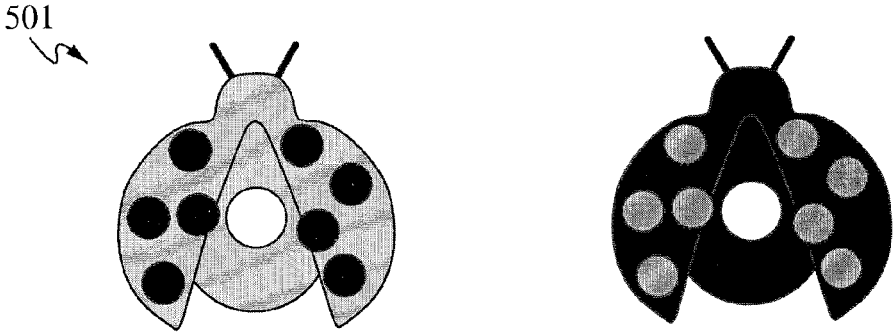
Figure 5D:
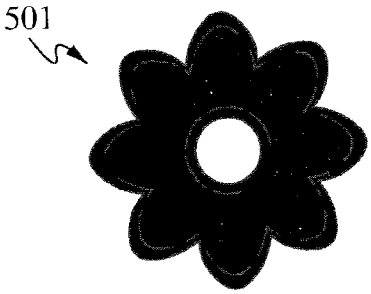
Figure 5E:
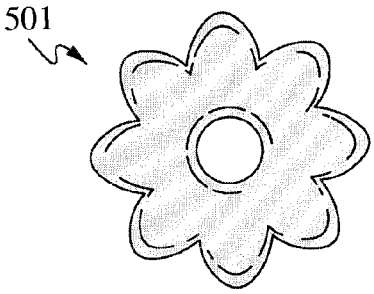
Figure 5F:
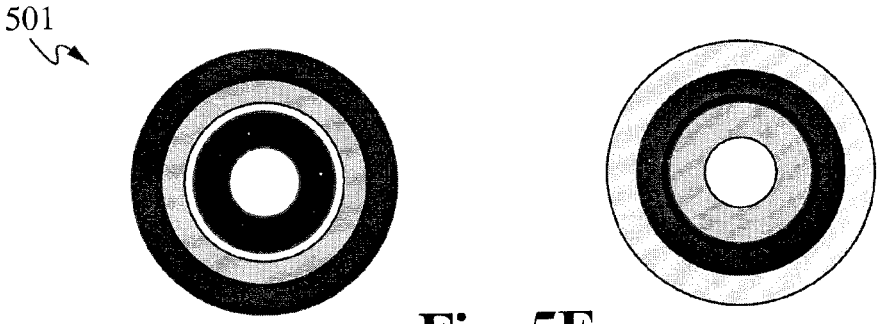

FIGS. 5A-5F illustrate a stretchable hair band 500 as described above in accordance with further embodiments. As shown in FIG. 5A, the stretchable body 501 of the hair band 500 comprises a substantially round shape. In some embodiments, as shown in FIGS. 5B-5E, the body 501 of the hair band 500 is able to comprise one or more of a heart, insect, and a flower. Alternatively, the body 501 is able to comprise any other decorative shape as known in the art. For example, in some embodiments the body 501 is able to comprise the shape of an animal. FIG. 5F illustrates the body 501 with designs on the cross section of the body 501. Particularly, the body 501 is able to comprise multiple designs on the middle as will be apparent to someone with ordinary skill in the art. Alternatively, as described above, the body 501 is able to further comprise a decorative accessory.

In operation, a user is able to move the hair band from a rest position to a stretched position in order to place a portion of hair within a center hole of the body. Then a user is able to release the hair band from the stretched position to a second rest position in order to securely hold the hair within a desired configuration. By doing so, the hair band has the advantage of providing an inexpensive and easy way for holding hair in place and for decorative purposes. Additionally, a user is able to move the hair band to a stretched position and secure a portion of hair without wrapping or doubling over the body of the hair band. Accordingly, in contrast to the prior art, a user is able to quickly stretch the center hole of the hair band, place a portion of hair within the hole, and release the hair band from the stretched position until the portion of hair is securely held within the center hole. Thus, the hair band described herein has numerous advantages.

The presently claimed invention has been described in terms of specific embodiments incorporating details to facilitate the understanding of the principles of construction and operation of the invention. Such reference herein to specific embodiments and details thereof is not intended to limit the scope of the claims appended hereto. It will be clear to someone skilled in the art that modifications area able to be made in the embodiment chosen for illustration without departing from the spirit and scope of the invention. Specifically, it will be clear that the hair band is able to be manufactured in a variety of sizes. Further, it will be clear to someone skilled in the art that the hair accessory is able to be constructed from a variety of materials and in a variety of configurations while still being compatible with the invention. Accordingly, the device of the invention is able to be implemented in several different ways and have several different appearances.

I claim:

1. A hair band comprising:

a stretchable body including an inner edge, an outer edge and an open center hole, wherein a distance between the inner edge and the outer edge is substantially greater than a center hole dimension at a rest position, and the distance between the inner edge and the outer edge decreases when the hair band is at a stretched position, the stretchable body being dimensioned whereby hair strands are receivable within the center hole when the stretchable body is in the stretched position and thereafter the stretchable body is released to return toward the rest position with the inner edge thereof engaging the hair strands in secured relation therewith without requiring further manipulation of the stretchable body about the hair strands, the center hole of the stretchable body being substantially circular and wherein the distance between the inner edge and the outer edge is at least twice a diameter of the center hole when the stretchable body is in the rest position.

2. A hair band, which comprises:

a solid stretchable body including an inner edge, an outer edge and an open center hole, wherein a distance between the inner edge and the outer edge is substantially greater than a center hole dimension at a rest position, and the distance between the inner edge and the outer edge decreases when the hair band is at a stretched position, the stretchable body being dimensioned whereby hair strands are receivable within the center hole when the stretchable body is in the stretched position and thereafter the stretchable body is released to return toward the rest position with the inner edge thereof engaging the hair strands in secured relation therewith without requiring further manipulation of the stretchable body about the hair strands.

3. The hair band of claim 1, wherein the stretchable body is hollow and filled with one or more of a gel substance, a granular solid, and a viscous liquid.

4. A hair band, which comprises:

a stretchable body including an inner edge, an outer edge and an open center hole, wherein a distance between the inner edge and the outer edge is substantially greater than a center hole dimension at a rest position, and the distance between the inner edge and the outer edge decreases when the hair band is at a stretched position, the stretchable body being dimensioned whereby hair strands are receivable within the center hole when the stretchable body is in the stretched position and thereafter the stretchable body is released to return toward the rest position with the inner edge thereof engaging the hair strands in secured relation therewith without requiring further manipulation of the stretchable body about the hair strands, the body including a fabric surface.

5. A hair band, which comprises:

a stretchable body including an inner edge, an outer edge and an open center hole, wherein a distance between the inner edge and the outer edge is substantially greater than a center hole dimension at a rest position, and the distance between the inner edge and the outer edge decreases when the hair band is at a stretched position, the stretchable body being dimensioned whereby hair strands are receivable within the center hole when the stretchable body is in the stretched position and thereafter the stretchable body is released to return toward the rest position with the inner edge thereof engaging the hair strands in secured relation therewith without requiring further manipulation of the stretchable body about the hair strands, the body including one or more of a decorative pattern, a graphic, and a decorative accessory.

6. The hair band of claim 1, wherein a width of the body is approximately ¼ inch, the center hole diameter is approximately ⅛ inch in a rest position.

7. The hair band of claim 1, wherein the body is infused with one or more of aloe, mineral oil, and a conditioning substance.

8. The hair band of claim 1, wherein the body comprises one or more of a sphere, a cube, and a tubular shape.

9. The hair band of claim 1, wherein the body is infused with an aroma.

10. The hair band of claim 1, wherein the body is infused with a a bitterant.

11. The hair band of claim 1, wherein the hair band is manufactured by one or more of an extrusion molding process and an injection molding process.

12. The hair band of claim 1, wherein the body comprises one or more of a heart, insect, animal, flower, and other decorative shape.

13. The hair band of claim 1, wherein the body comprises multiple designs.

14. A hair band comprising:

a stretchable body including an outer edge and an inner edge, the inner edge defining a generally circular center hole for receiving hair strands, the stretchable body movable between a rest position and a stretched position, wherein a first distance between the outer edge and the inner edge is at least two times greater than a first center hole diameter when the stretchable body is in the rest position, and wherein the second distance between the outer edge of the body and the inner edge is less than a second center hole diameter when the stretchable body is in the stretched position and wherein hair strands are receivable within the circular center hold when the stretchable body is in the stretched position and the stretchable body is released to permit the stretchable body to move directly toward its rest position with the inner edge thereof engaging the hair strands in secured relation therewith without requiring further manipulation of the stretchable body about the hair strands.

15. The hair band of claim 14, wherein the stretchable body is solid and comprises a gel material.

16. The hair band of claim 14, wherein the stretchable body is hollow and filled with one or more of a gel substance, a granular solid, and a viscous liquid.

17. The hair band of claim 14, wherein the body comprises a fabric surface.

18. A method of utilizing a hair band with a body and a center hole comprising:

a. moving the hair band from a first rest position with a first center hole diameter and a first distance between an outer edge and the center hole to a stretched position with a second center hole diameter and a second distance between the outer edge and the center hole;

b. placing a portion of hair within the center hole; and c. releasing the hair band from the stretched position to a second rest position to securely hold the portion of hair without requiring any twisting movement of the hair band relative to the hair, wherein when the hair band is in the second rest position, the center hole diameter is greater than the first center hole diameter and the distance between an outer edge and the center hole is greater than the first distance between an outer edge and the center hole.

19. The hair band of claim 1 wherein the stretchable body comprises a gel material.

20. The hair band of claim 14, wherein the stretchable body comprises a gel material.

21. A method of securing hair strands, comprising the steps of:

a. transitioning a stretchable body of a hair band from a rest position where a hole extending through the stretchable body defines a first hole dimension and a first distance between an outer edge of the stretchable body and an inner edge defining the hole, to a stretched position where the hole defines a second center hole dimension greater than the first hole dimension and a second distance between the outer edge and the inner edge less than the first distance; the step of transitioning including stretching the stretchable body from the rest position where the first distance of the stretchable body is at least twice the size of the first hole dimension of the hole of the stretchable body to the stretched position;

b. introducing a portion of hair within the hole of the stretchable body; and c. releasing the stretchable body from the stretched position whereby the stretchable body moves toward the rest position such that the portion of the hair is secured within the inner edge of the stretchable body.

22. The method according to claim 21 wherein the hole of the stretchable body is substantially circular when the stretchable body is in the rest position.

* * * * *